US007802362B2

(12) United States Patent
Hou et al.

(10) Patent No.: US 7,802,362 B2
(45) Date of Patent: Sep. 28, 2010

(54) METHOD OF MAKING HEAT PIPE HAVING COMPOSITE CAPILLARY WICK

(75) Inventors: Chuen-Shu Hou, Tu-Cheng (TW); Cheng-Hui Lin, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 1056 days.

(21) Appl. No.: 11/309,659

(22) Filed: Sep. 7, 2006

(65) Prior Publication Data

US 2007/0267179 A1 Nov. 22, 2007

(30) Foreign Application Priority Data

May 19, 2006 (CN) ..... 2006 1 0060729

(51) Int. Cl.
*B23P 6/00* (2006.01)
*B23Q 3/00* (2006.01)
*B21D 53/06* (2006.01)

(52) U.S. Cl. ..... 29/890.032; 29/890.036; 29/890.045; 29/890.049; 29/464; 165/104.26; 165/104.21

(58) Field of Classification Search ..... 29/890.032, 29/890.036, 890.045, 890.049, 464, 726; 165/104.26, 104.21, 104.33
See application file for complete search history.

(56) References Cited

U.S. PATENT DOCUMENTS 3,964,902 A * 6/1976 Fletcher et al. ..... 29/890.032
4,196,504 A * 4/1980 Eastman ..... 29/890.032
4,274,479 A * 6/1981 Eastman ..... 165/104.26
4,565,243 A * 1/1986 Ernst et al. ..... 165/104.26
5,076,352 A * 12/1991 Rosenfeld et al. ..... 165/104.26
7,303,001 B2 * 12/2007 Leu et al. ..... 165/104.26
2006/0179653 A1 * 8/2006 Sun et al. ..... 29/890.032
2006/0180296 A1 * 8/2006 Liu ..... 165/104.26
2006/0207750 A1 * 9/2006 Chang et al. ..... 165/104.26
2006/0213061 A1 * 9/2006 Wu et al. ..... 29/890.032
2006/0260786 A1 * 11/2006 Hsu ..... 165/104.26
2007/0044308 A1 * 3/2007 Chen ..... 29/890.032

FOREIGN PATENT DOCUMENTS

CN 200320117731.1 Y 11/2004
CN 200320121761.X Y 12/2004
CN 200420112393.7 Y 12/2004
TW 227910 10/2005

* cited by examiner

*Primary Examiner*—David P Bryant
*Assistant Examiner*—Sarang Afzali
(74) *Attorney, Agent, or Firm*—Jeffrey T. Knapp

(57) ABSTRACT

A method of making a heat pipe includes the steps of: providing a mandrel, a capillary wick and a straight tubular shell; inserting the mandrel and the capillary wick into the shell; cramming powder into the shell, wherein the powder can be sintered between the shell and the mandrel; sintering the shell having the mandrel, the capillary wick and the powder therein; and drawing the mandrel out of the shell and filling working media into the pipe, and vacuuming and sealing the pipe. The mandrel defines a longitudinal slot therein, and the capillary wick is positioned in the slot.

9 Claims, 16 Drawing Sheets

METHOD OF MAKING HEAT PIPE HAVING COMPOSITE CAPILLARY WICK

FIELD OF THE INVENTION

The present invention relates generally to a heat pipe, and more particularly to a heat pipe having composite capillary wick and a method of making the same.

DESCRIPTION OF RELATED ART

As a heat transfer apparatus, heat pipes can transfer heat rapidly and therefore are widely used in various fields for heat dissipation purposes. For example, heat pipes are commonly applied to transfer heat from heat-generating electronic components, such as central processing units (CPUs), to heat dissipating devices, such as heat sinks, thereby removing and dissipating heat build-up. A heat pipe in accordance with related art generally includes a sealed shell made of thermally conductive material and a working fluid contained in the shell. The working fluid is employed to carry heat from one end of the shell, typically called as "evaporating section", to the other end of the shell, typically called as "condensing section". Specifically, when the evaporating section of a heat pipe is thermally attached to a heat-generating electronic component, the working fluid contained therein receives heat from the electronic component and evaporates. Then, the generated vapor moves towards the condensing section of the heat pipe under the vapor pressure gradient between the two sections. In the condensing section, the vapor is condensed to a liquid state by releasing its latent heat to, for example, a heat sink attached to the condensing section. Thus, the heat is removed away from the electronic component.

In order to rapidly return the condensed liquid back from the condensing section to the evaporating section to start another cycle of evaporation and condensation, a capillary wick is generally provided in an inner surface of the shell in order to accelerate the return of the liquid. In particular, the liquid is drawn back to the evaporating section by a capillary force developed by the capillary wick. The capillary wick may be a plurality of fine grooves defined in a lengthwise direction of the shell, a fine-mesh wick, or a layer of sintered metallic or ceramic powder. However, most of heat pipes adopt a single type of capillary wick. When such a heat pipe is bent or flattened, it is not possible to ensure the smooth transport of the vapor contained therein. What is more, the capillary wick is prone to damage. The performance of the heat pipe may be adversely affected and downgraded as a result.

In order to overcome the above-mentioned shortcomings, composite capillary wick can be applied inside a heat pipe. For instance, FIG. 16 shows a heat pipe in accordance with related art, which has a plurality of grooves defined therein to form a groove-type capillary wick. A mesh capillary wick is employed within the heat pipe but is unfixed. However, since the mesh capillary wick is unfixed, the mesh capillary wick can move freely in the shell and may adversely affect vapor flow.

In view of the above-mentioned disadvantage of the heat pipe, there is a need for a heat pipe having reliably good heat transfer.

SUMMARY OF THE INVENTION

A heat pipe in accordance with a preferred embodiment of the present invention includes a shell containing a working media therein, a first capillary wick, a second capillary wick and a vapor channel enclosed by the first and second capillary wicks. The first capillary wick is positioned on an inner side of the shell. The second capillary wick is longitudinally attached to the first capillary wick. Since the first capillary wick is positioned on the inner side of the shell, and the second capillary wick is united with the first capillary wick, the locations of the first and second capillary wicks are constantly fixed. Thus, movement of the first and second capillary wicks in the vapor channel is prevented. A high heat-transfer performance of the heat pipe is ensured.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present apparatus and method can be better understood with reference to the following drawings. The components in the drawings are not necessarily drawn to scale, the emphasis instead being placed upon clearly illustrating the principles of the present apparatus and method. Moreover, in the drawings, like reference numerals designate corresponding parts throughout the several views.

DETAILED DESCRIPTION OF THE INVENTION

Figure 1:
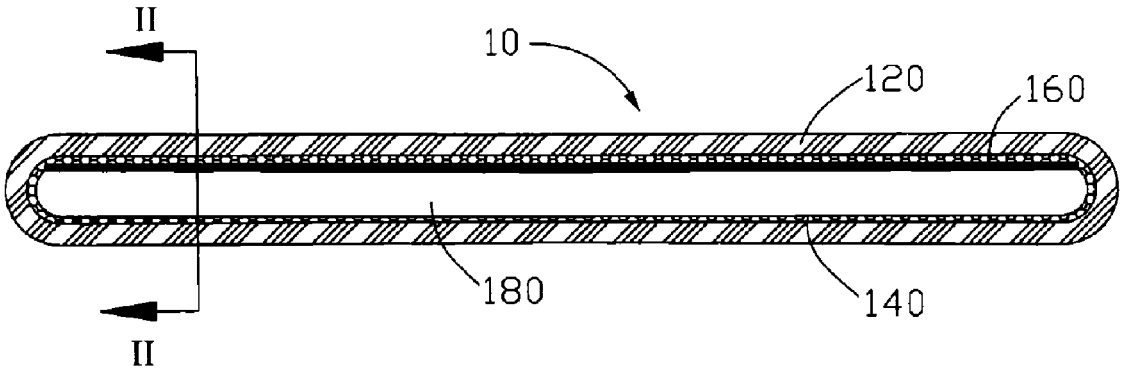
FIG. 1 is a longitudinal cross-sectional view of a heat pipe in accordance with a first embodiment of the present invention.
Figure 2:
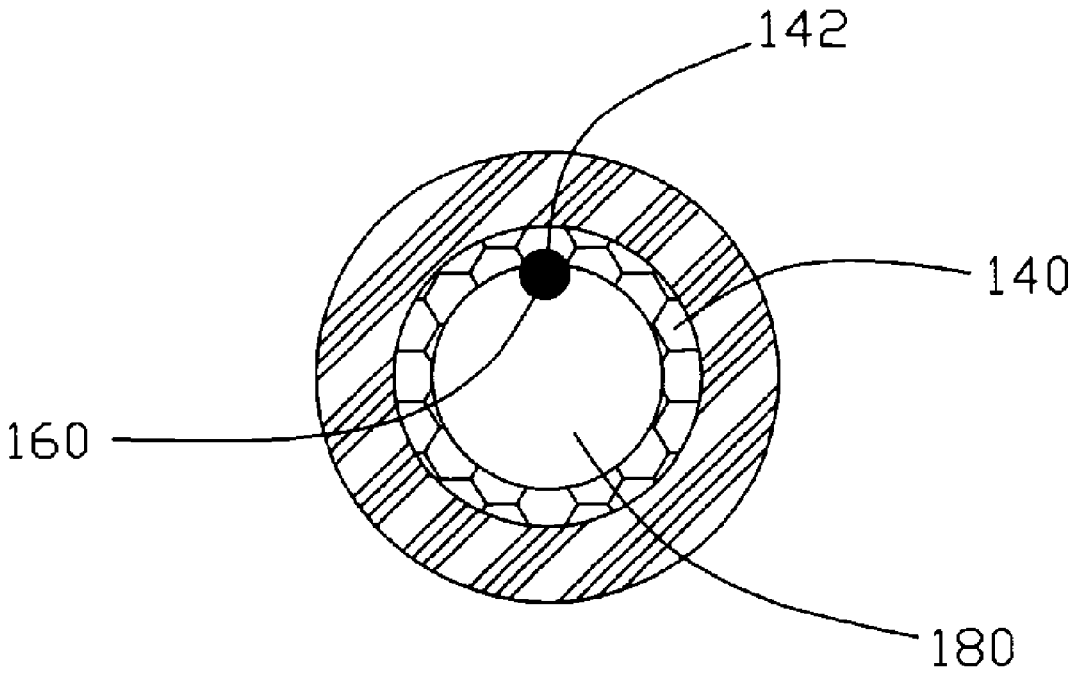
FIG. 2 is a radial cross-sectional view of the heat pipe of FIG. 1, taken along line II-II thereof.

FIGS. 1 and 2 illustrate a heat pipe 10 in accordance with a first embodiment of the present invention. The heat pipe 10 comprises a straight tubular shell 120 having working media contained therein, a first capillary wick 140 positioned on an inner surface of the shell 120 and a rod-shaped second capillary wick 160 positioned on an inner side of the first capillary wick 140. A vapor channel 180 is enclosed by the first and second capillary wicks 140, 160 for transporting vapor in the shell 120. The first capillary wick 140 is circumferentially and longitudinally spread on the inner side of the shell 120. A longitudinal arched groove 142 is defined in the first capillary wick 140 for receiving the second capillary wick 160 therein. The second capillary wick 160 is attached to the first capillary wick 140 and extended into the vapor channel 180 from the longitudinal groove 142. In this embodiment the first capillary wick 140 is made via sintering metallic or ceramic powders and the second capillary wick 160 is made of fiber. Alternatively, the second capillary wick 160 can be formed using other types of wicks, such as mesh-type of wick, beehive-type wick, micro-tubes, and metallic foil.

Figure 5:
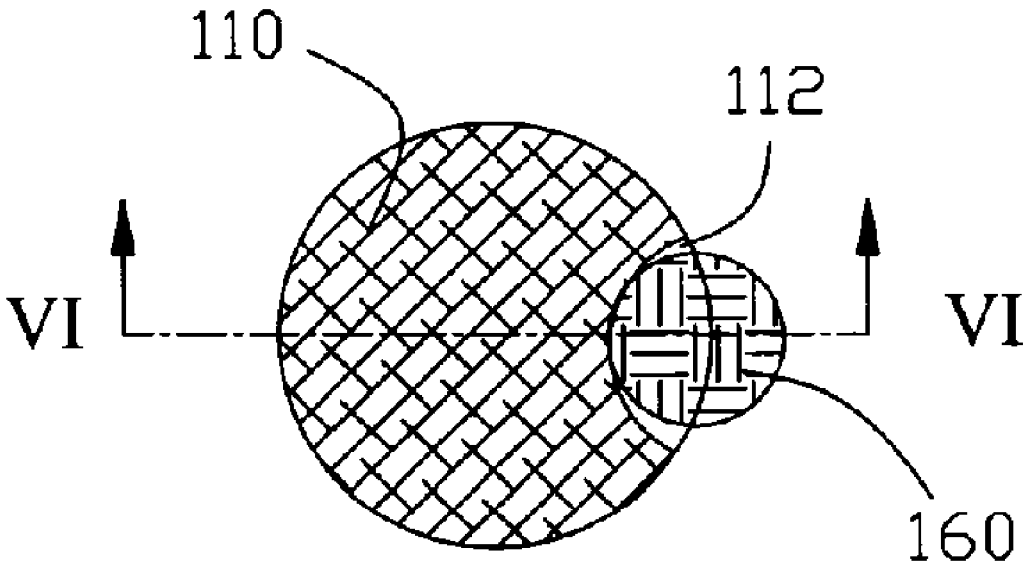
FIG. 5 is a radial cross-sectional view of the mandrel of FIG. 3 and a piece of capillary wick.
Figure 6:
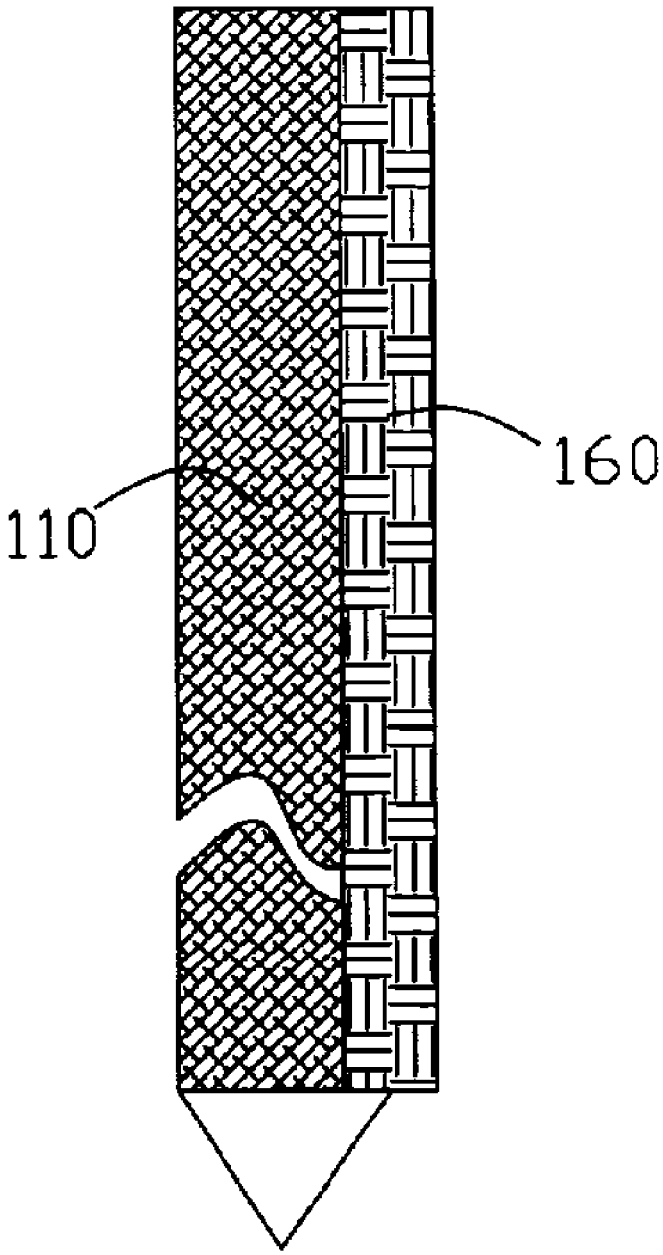
FIG. 6 is a longitudinal cross-sectional view of the mandrel and the piece of capillary wick of FIG. 5, taken along line VI-VI thereof.
Figure 7:
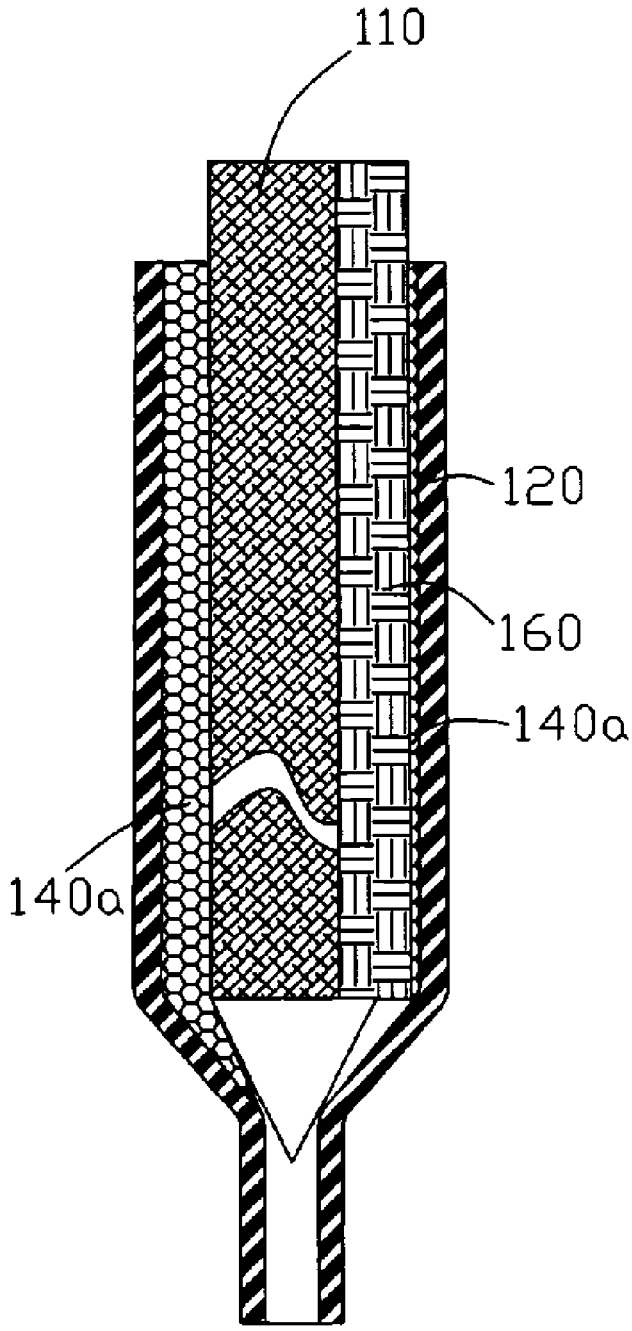
FIG. 7 is a longitudinal cross-sectional view of the heat pipe before the mandrel is drawn out therefrom.
Figure 8:
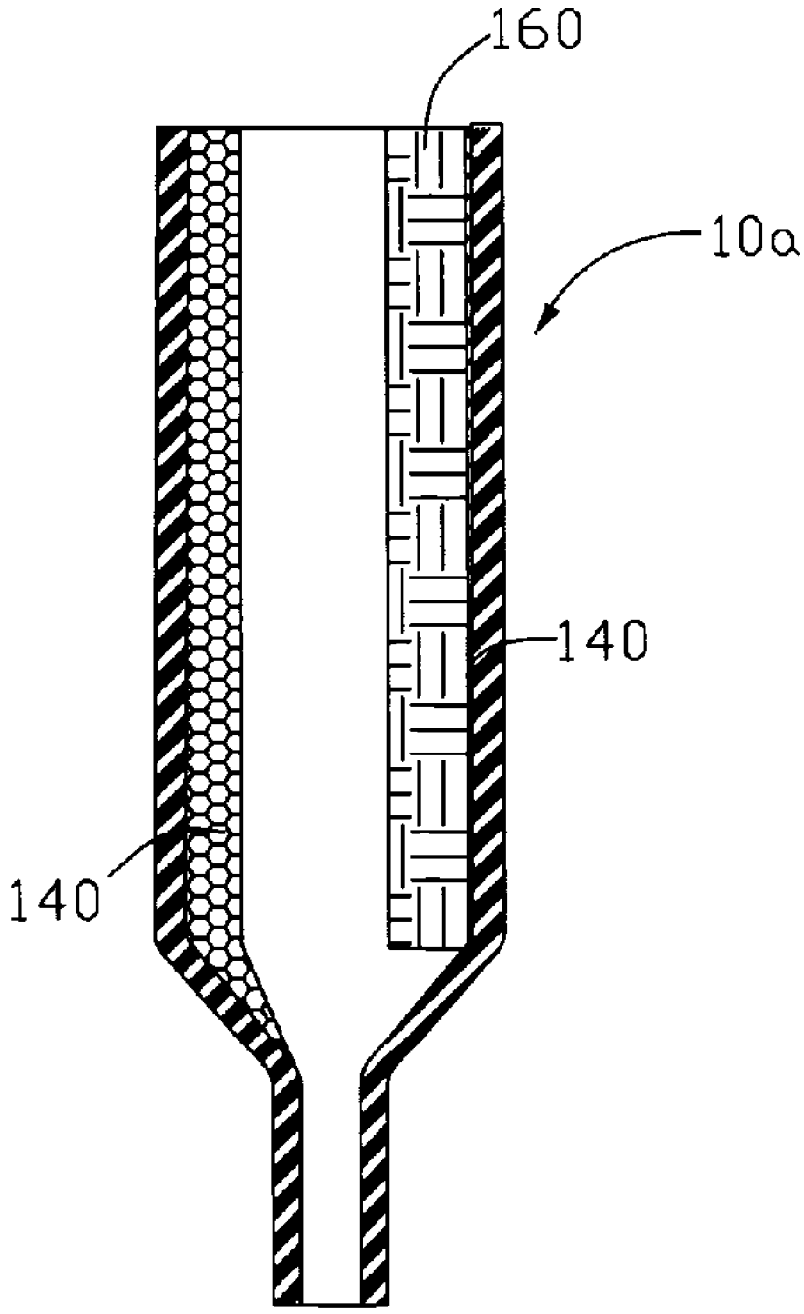
FIG. 8 is similar to FIG. 7, but with the mandrel having been drawn out from the heat pipe.

FIGS. 3-8 illustrate a process of manufacturing the heat pipe 10. First, a cylindrical mandrel 110 is provided. The mandrel 110 longitudinally defines an arched slot 112 therein. Second, the second capillary wick 160 is partially accommodated in the slot 112 in this embodiment, as shown in FIGS. 5-6, for facilitating mass-production. Also referring to FIG. 7, the mandrel 110 and the second capillary wick 160 are inserted into the shell 120. A space between the mandrel 110 and the shell 120 is filled with metallic or ceramic powder 140*a*. Then, the shell 120 having the mandrel 110, the metallic or ceramic powder 140*a* and the second capillary wick 160 therein is sintered, so that the powder 140*a* becomes the first capillary wick 140 and that the second capillary wick 160 is joined with the first capillary wick 140. Simultaneously, the first capillary wick 140 is positioned on the inner side of the shell 120 due to the sintering process. After that, the mandrel 110 is drawn out from the shell 120 and the first and second capillary wicks 140, 160 are held in position in the shell 120 firmly as shown in FIG. 8. Subsequent processes such as injecting working media into the shell 120, vacuuming and sealing the shell 120 can be performed using conventional ways. Thus, a straight heat pipe 10 as shown in FIGS. 1-2 is attained. The heat pipe 10 finally can be bent to have L-shaped or U-shaped configurations. The heat pipe 10 can also be flattened to have a rectangular cross-section, such as those shown in FIGS. 13, 15 for example.

The locations of the first and second capillary wicks 140, 160 are fixed in the shell 120 of the heat pipe 10. Thus, movement of the first and second capillary wicks 140, 160 in the vapor channel 180 is prevented, even if the heat pipe is bent or flattened.

Figure 3:
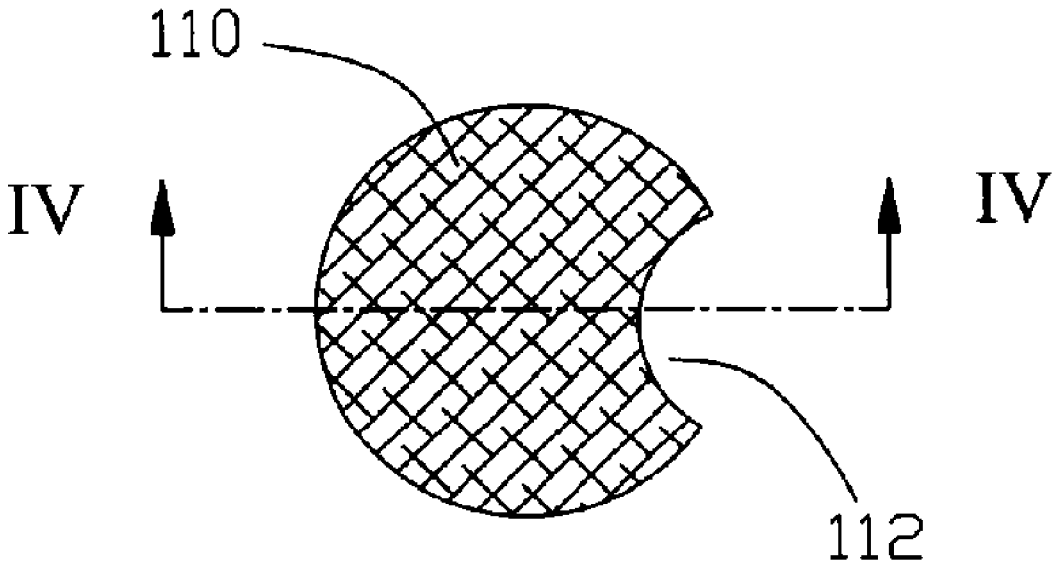
FIG. 3 is a radial cross-sectional view of a mandrel used for manufacturing the heat pipe of FIG. 1.
Figure 4:
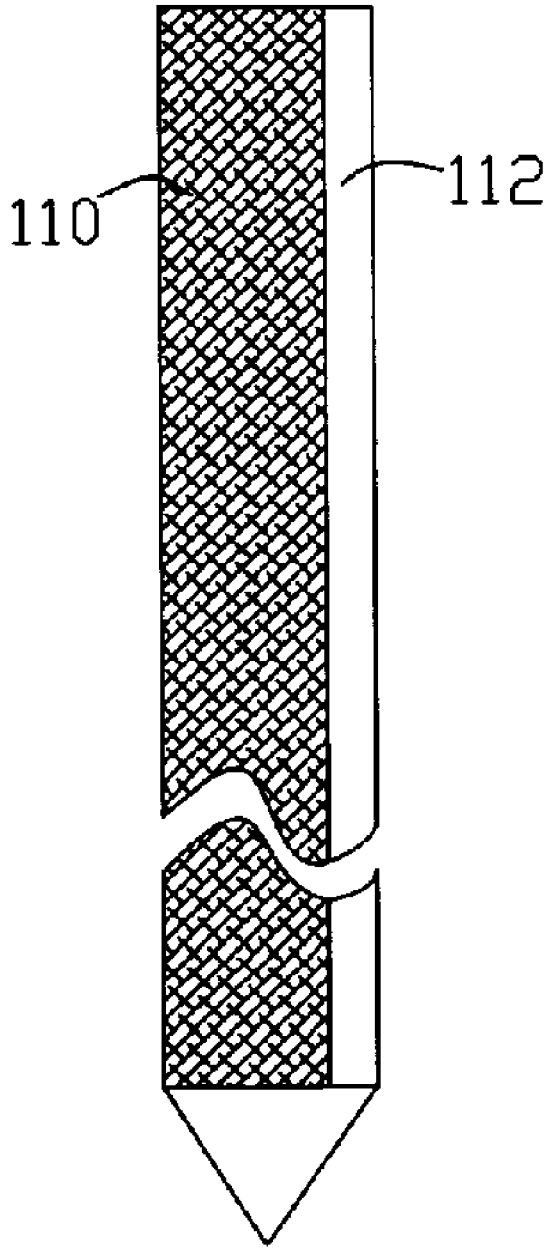
FIG. 4 is a longitudinal cross-sectional view of the mandrel of FIG. 3, taken along line IV-IV thereof.
Figure 9:
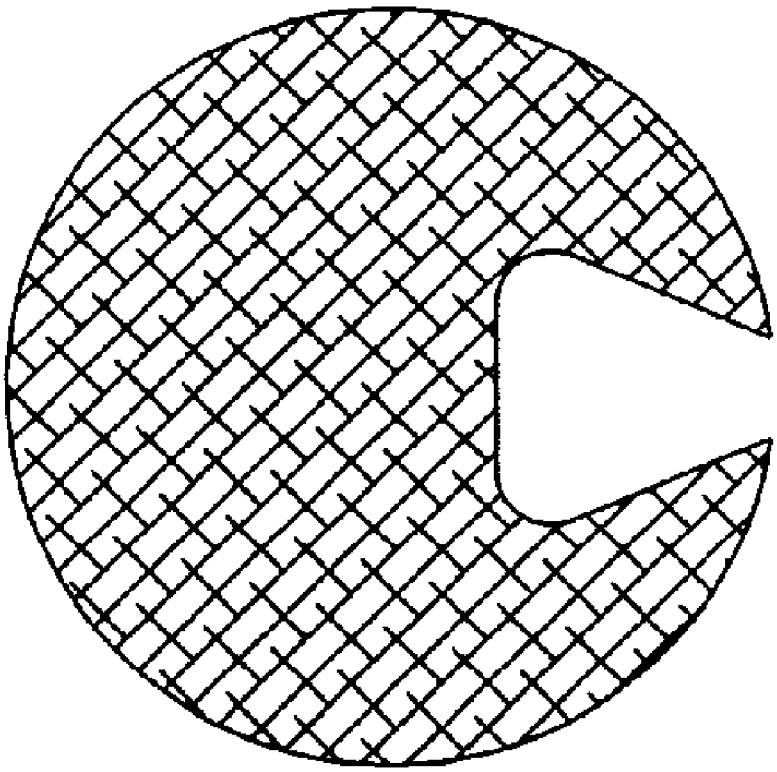
FIGS. 9-11 are radial cross-sectional views of mandrels different from the mandrel of FIG. 3.
Figure 10:
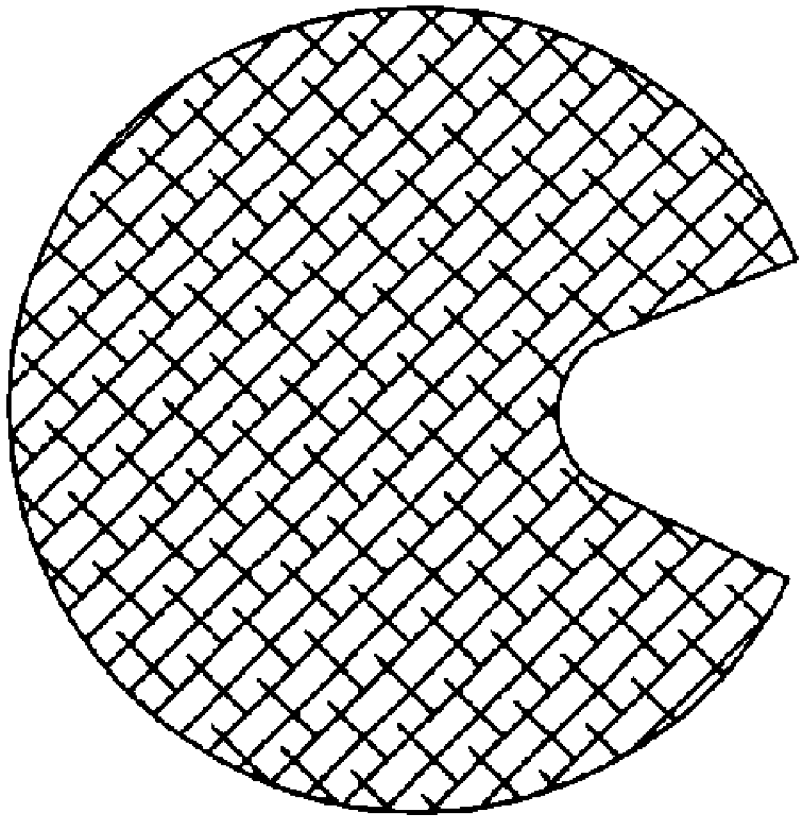
Figure 11:
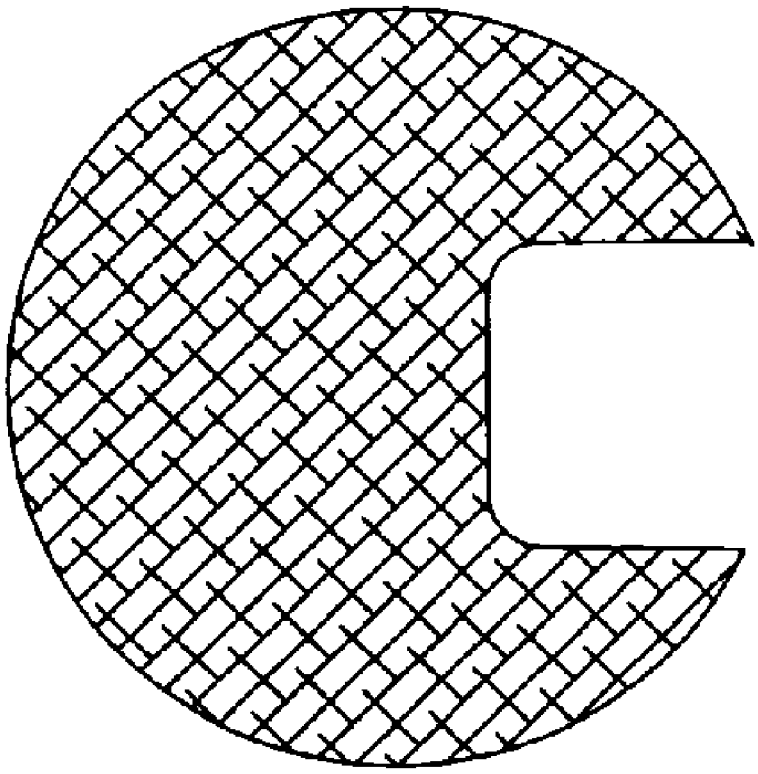

In practice, other mandrels having different configurations can be substituted for the mandrel 110 of FIG. 3. FIGS. 9-11 show examples of mandrels suitable to substitute for the mandrel 110 of FIG. 3. Correspondingly, the configuration of the second capillary wick 160 can be changed accordingly (see FIGS. 13, 15).

Figure 12:
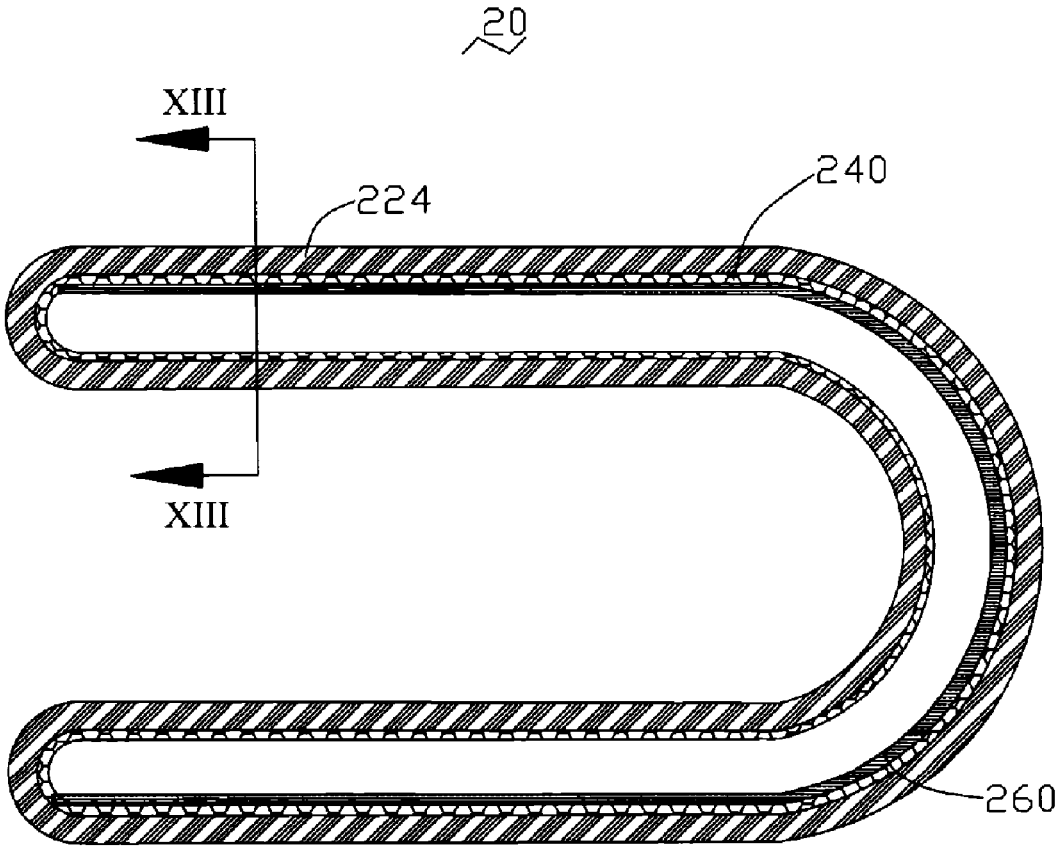
FIG. 12 is a longitudinal cross-sectional view of a heat pipe in accordance with a second embodiment of the present invention.
Figure 13:
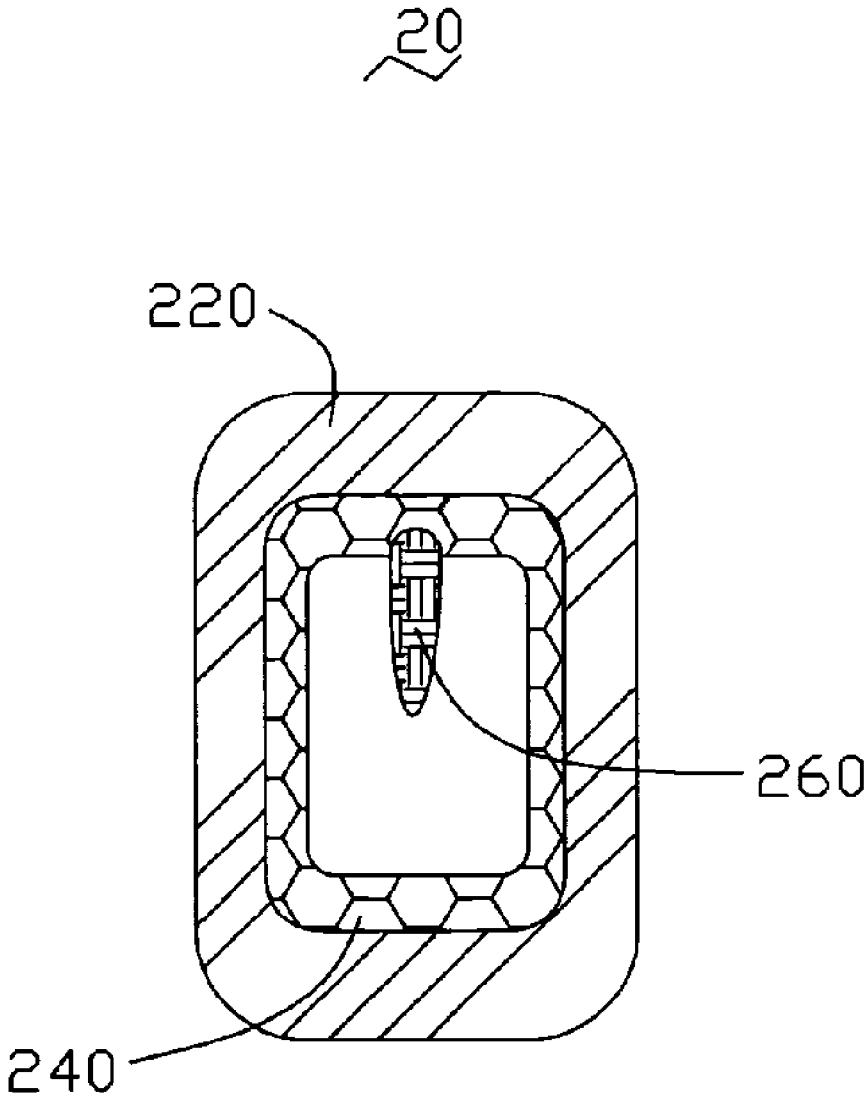
FIG. 13 is a radial cross-sectional view of the heat pipe of FIG. 12, taken along line XIII-XIII thereof.

FIGS. 12-13 show a heat pipe 20 in accordance with a second embodiment of the present invention. The heat pipe 20 is U-shaped and flattened to have a rectangular cross-section. The heat pipe 20 comprises a shell 220, a first capillary wick 240 and a second capillary wick 260. The first capillary wick 240 is arranged on an inner surface of the shell 220. The second capillary wick 260 is united together with the first capillary wick 240 and located adjacent to an outer wall 224 of the shell 220.

Figure 14:
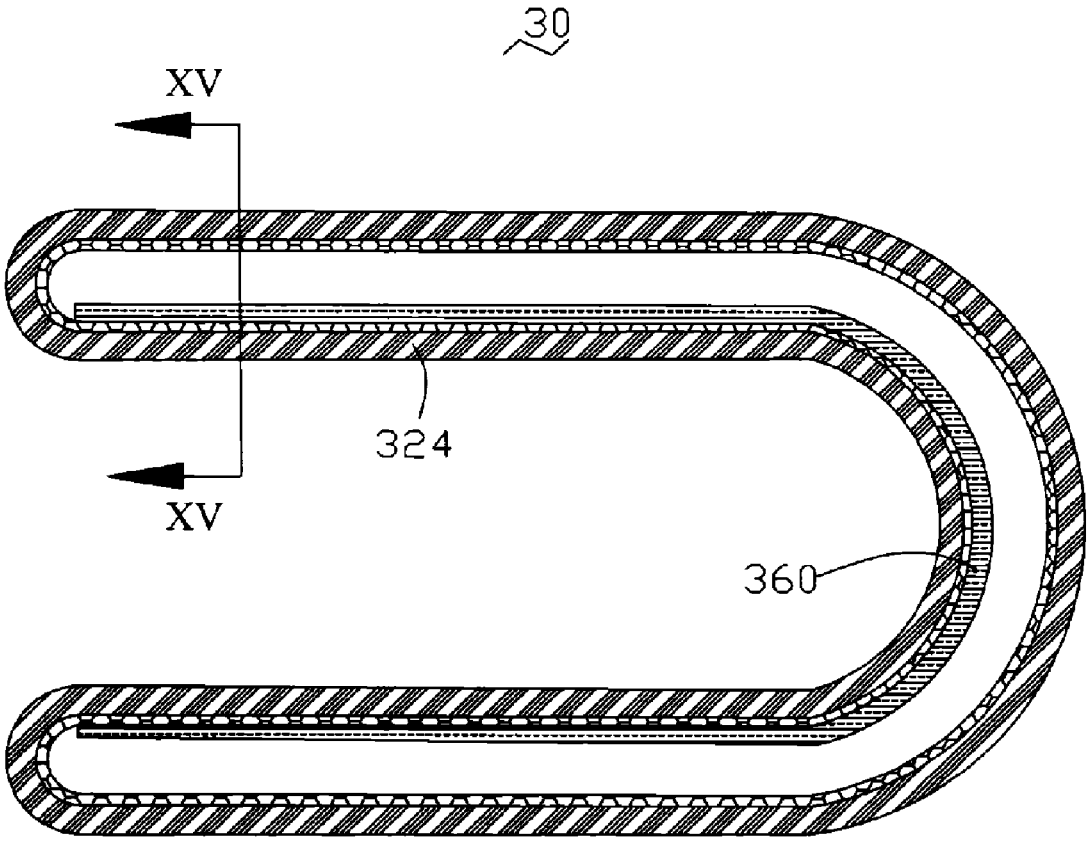
FIG. 14 is a longitudinal cross-sectional view of a heat pipe in accordance with a third embodiment of the present invention.
Figure 15:
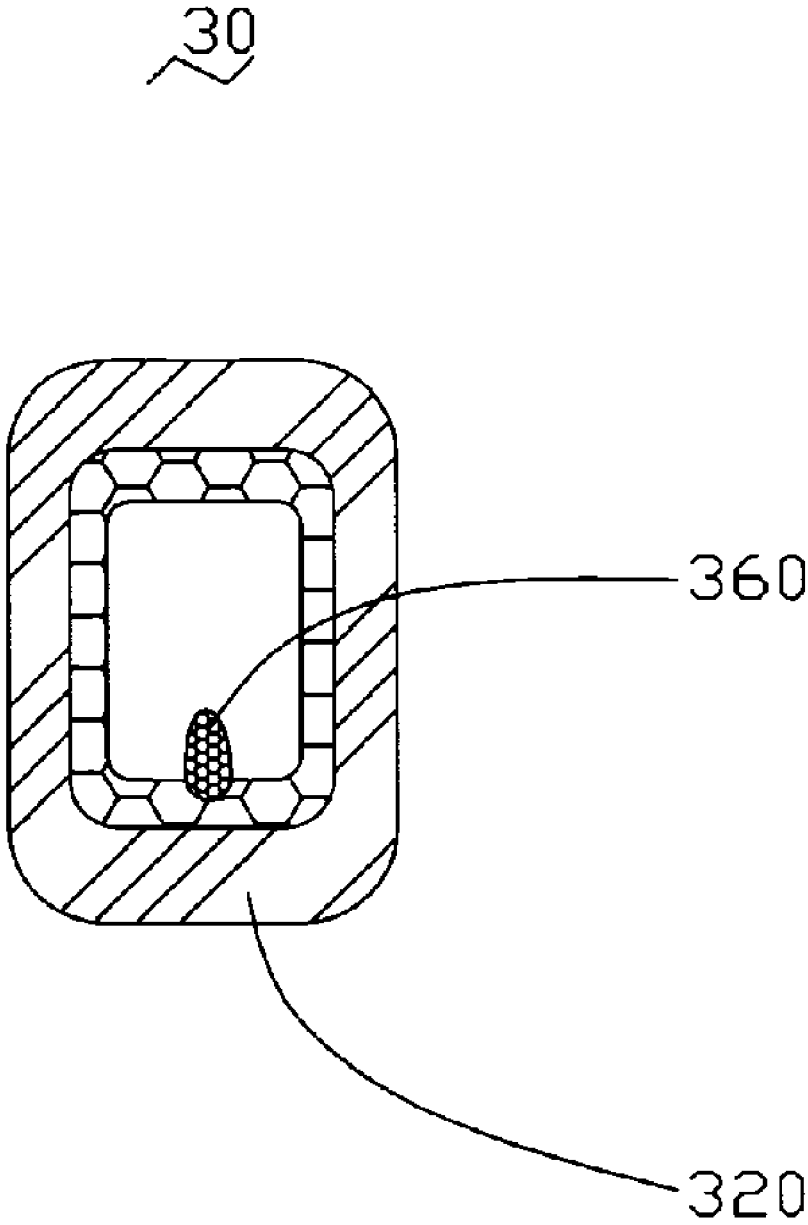
FIG. 15 is a radial cross-sectional view of the heat pipe of FIG. 14, taken along line XV-XV thereof.
Figure 16:
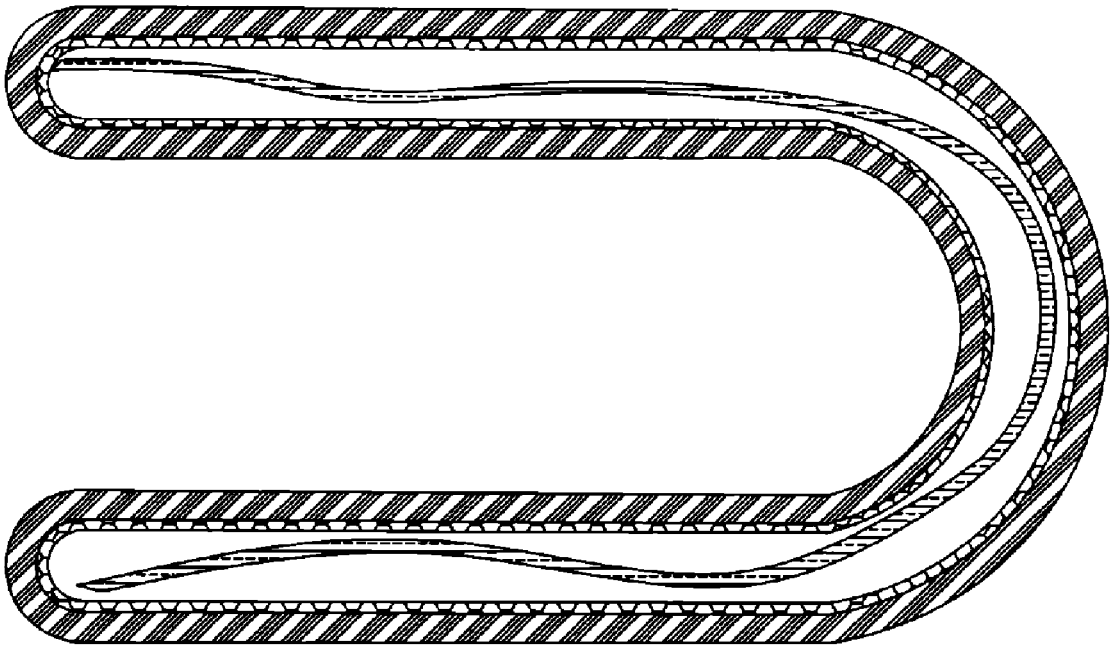
FIG. 16 (RELATED ART)
FIG. 16 is a longitudinal cross-sectional view of a heat pipe in accordance with related art.

FIGS. 14-15 show a heat pipe 30 in accordance with a third embodiment of the present invention. The heat pipe 30 is similar to the heat pipe 20, but the second capillary wick 360 is located adjacent to an inner wall 324 of the shell 320.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for forming a heat pipe, comprising:

preparing a tubular shell;

inserting a mandrel into the shell, wherein the mandrel defines a slot longitudinally extending in a circumferential periphery thereof, the slot being inserted with a capillary wick therein, the capillary wick having a portion protruding out of the slot;

inserting powder into the shell to fill a space between the shell, the capillary wick and the mandrel;

heating the powder so that the powder is sintered to the shell and the capillary wick;

drawing the mandrel out of the shell; and injecting working fluid into the shell, vacuuming the shell and sealing the shell.

2. The method of claim 1, wherein the shell is bent into a curved configuration after the step of injecting working fluid.

3. The method of claim 2, wherein the shell has a U-shaped configuration, and the capillary wick is attached to one of an inner wall and an outer wall of the shell.

4. The method of claim 1, wherein the capillary wick is a mesh-type capillary wick.

5. The method of claim 1, wherein the powder is one of metallic powder and ceramic powder.

6. The method of claim 1, wherein the shell is flattened into a rectangular cross section after the step of injecting working fluid.

7. A method of making a heat pipe, comprising the steps of:

providing a mandrel, a capillary wick and a straight tubular shell;

inserting the mandrel and the capillary wick into the shell;

cramming powder into the shell, wherein the powder can be sintered between the shell and the mandrel;

sintering the shell having the mandrel, the capillary wick and the powder therein; and drawing the mandrel out of the shell and filling working media into the pipe, and vacuuming and sealing the pipe;

wherein the mandrel defines a longitudinal slot therein, and the capillary wick is positioned in the slot.

8. The method of claim 7, wherein the capillary wick is partially accommodated in the slot, before the mandrel and the capillary wick are inserted into the shell.

9. The method of claim 7, wherein the capillary wick is selected from the group consisting of a mesh-type wick, a beehive-type wick, micro-tubes and metallic foil.

* * * * *